United States Patent [19]

Verzilli

[11] Patent Number: 5,038,439

[45] Date of Patent: Aug. 13, 1991

[54] FEED DEVICE FOR A CARD

[75] Inventor: Giuseppe Verzilli, Wiesendangen, Switzerland

[73] Assignee: Rieter Machine Works, Ltd., Winterthur, Switzerland

[21] Appl. No.: 393,875

[22] Filed: Aug. 14, 1989

[30] Foreign Application Priority Data

Aug. 12, 1988 [DE] Fed. Rep. of Germany ..... 3827520

[51] Int. Cl.[5] ..... D01G 15/20

[52] U.S. Cl. ..... 19/105

[58] Field of Search ..... 19/105, 107, 108, 109, 19/106, 111, 110, 262, 98

[56] References Cited

U.S. PATENT DOCUMENTS

| | | | |
|---|---|---|---|
| 2,532,330 | 12/1950 | Ramsdell | 19/107 |
| 2,683,901 | 7/1954 | Griswold | 19/111 |
| 3,108,331 | 10/1963 | Reiterer | 19/106 R |
| 3,115,533 | 12/1963 | Reiterer | 19/105 |
| 3,321,810 | 5/1967 | Burnham | 19/111 |
| 3,483,598 | 12/1969 | Bryan, Jr. | 19/105 |
| 3,520,028 | 7/1970 | Crowley, Jr. | 19/107 |
| 3,678,538 | 7/1972 | Sloan | 19/107 |
| 3,707,020 | 12/1972 | Stewart | 19/107 |
| 3,737,952 | 6/1973 | Oneal et al. . | |
| 4,064,598 | 12/1977 | Katoh et al. | 19/105 |
| 4,126,915 | 11/1978 | Zieg et al. | 19/111 |
| 4,241,475 | 12/1980 | Miller | 19/98 |
| 4,400,852 | 8/1983 | Löffler | 19/106 R |
| 4,642,850 | 2/1987 | Giulani | 19/105 |
| 4,860,406 | 8/1989 | Stäheli et al. | 19/105 |

FOREIGN PATENT DOCUMENTS

| | | | |
|---|---|---|---|
| 0022472 | 1/1981 | European Pat. Off. . | |
| 2743187 | 9/1976 | Fed. Rep. of Germany | 19/107 |
| 2322941 | 4/1977 | France . | |
| 45-18050 | 6/1970 | Japan | 19/107 |
| 385682 | 3/1965 | Switzerland . | |
| 0663965 | 2/1984 | Switzerland . | |
| 982809 | 2/1965 | United Kingdom | 19/107 |
| 1230331 | 4/1971 | United Kingdom | 19/105 |

*Primary Examiner*—Werner H. Schroeder
*Assistant Examiner*—John J. Calvert
*Attorney, Agent, or Firm*—Kenyon & Kenyon

[57] ABSTRACT

A suction tube extends in parallel between the licker-in and the feed plate of the co-direction feed device while a supply duct extends from the fiber lap delivery point to the suction tube. The suction tube and duct serve to remove dirt by suction and extraction at the delivery point where the fiber lap is delivered to the licker-in. The supply duct extends tangentially into the suction tube in order to maintain the entrained dirt particles in a helical flow in the tube.

15 Claims, 2 Drawing Sheets

FEED DEVICE FOR A CARD

Figure 1:
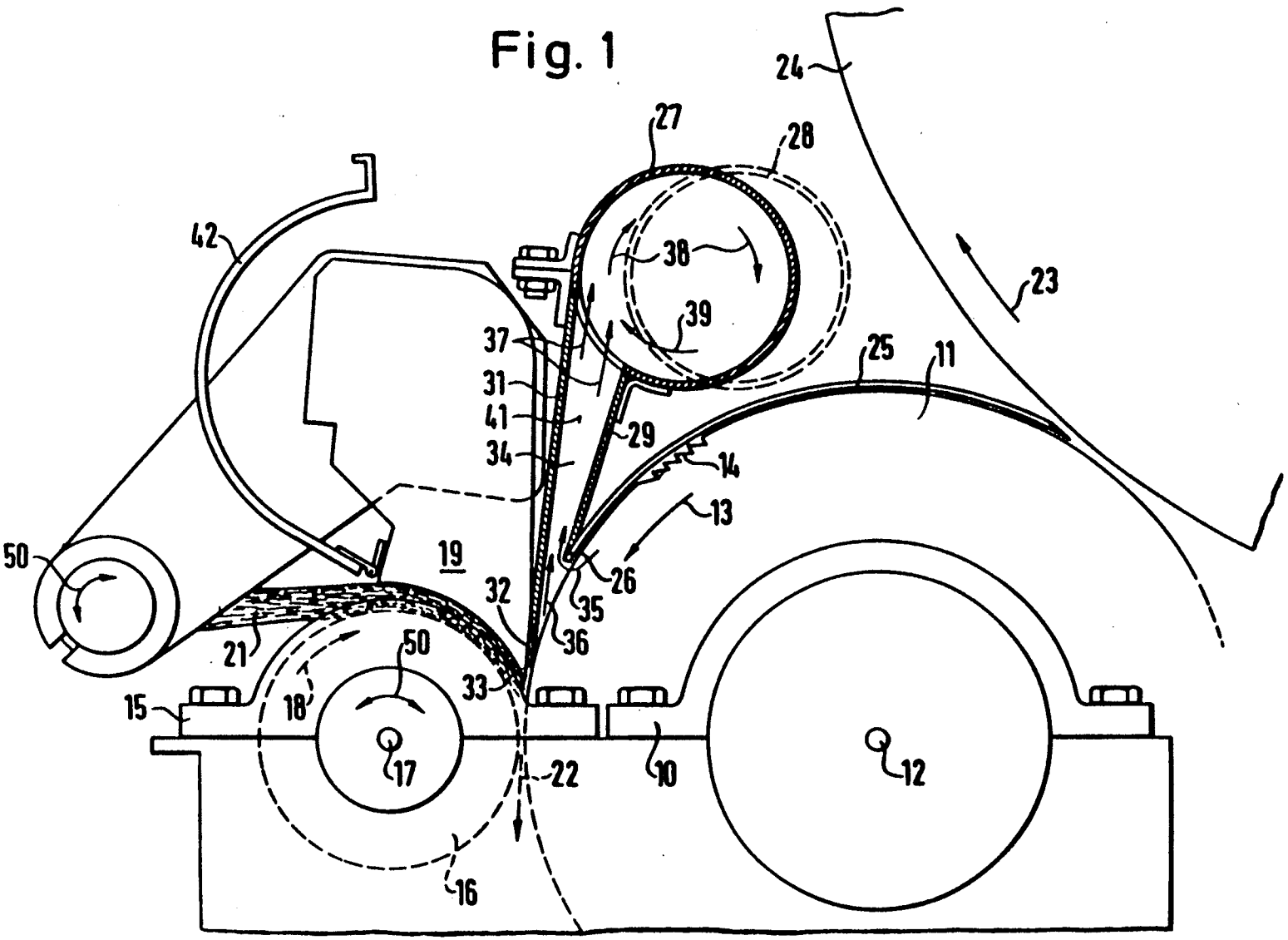

This invention relates to a feed device for a card.

As is known, cards have been provided with various types of feed devices in order to feed a fiber lap to a card. For example, European Patent 0022472 describes a codirectional feed device with suction-extraction for a card comprising a feed roller and a feed plate cooperating therewith to supply a fiber lap to a licker-in. In addition, a suction-extraction duct extends over the entire length of the feed plate or the entire axial length of the licker-in and, for dirt removal, applies suction to the place where the fiber lap is delivered by the feed plate or feed roller to the licker-in. The suction-extraction duct described therein has been found very effective in practice. In this respect, the duct is usually successful in removing a considerable number of dirt particles, dust and the like from the tips of the licker-in surface entering the delivery place or from the air supplied to the licker-in, so that the dirt or dust particles cannot cause difficulty during subsequent processing of the fibers.

The problem of dirt removal has become more pressing recently, now that the cotton harvest is increasingly mechanized, resulting in a considerable increase in dirt in the cotton flocks. In spite of great care in opening the bales and cleaning the flocks, dirt particles recurrently enter the preparatory machines in the spinning mill.

Although the device described in European patent 0022472 has given excellent results in practice, it occasionally, though rarely, happens that concentrations of dirt particles occur near the swift. It has been found that these concentrations of dirt particles are due to the fact that although dirt is removed at the delivery place of the suction-extraction duct, some dirt remains caught in the suction-extraction duct and occasionally falls back into the delivery place, where the licker-in presses the dirt into the fiber lap and subsequently conveys the dirt to the swift.

Accordingly, it is an object of the invention to improve a codirectional feed device with suction-extraction so that accumulations of dirt no longer remain caught in the suction-extraction duct or at least in critical regions thereof.

It is another object of the invention to efficiently remove dirt from fiber lap delivered to a card.

It is another object of the invention to provide a relatively simple feed device for removing impurities from a fiber lap delivered to a licker-in of a card.

Briefly, the invention provides a feed device for a card which includes a feed roller, a feed plate disposed in spaced relation to the roller to define a passage for conveying a fiber lap therebetween to a delivery point for delivery to a licker-in, a suction tube extending longitudinally of the roller and plate for connecting to a suction source and a supply duct extending from the delivery point to the suction tube. In accordance with the invention, the supply duct opens tangentially into the suction tube along an axial length thereof for delivering dirt particles extracted from the fiber lap at the delivery point to the suction tube.

The suction tube is constructed with a cylindrical inner passage so that with the supply duct opening tangentially into the tube, a sort of helical flow of air and conveyed particles is formed within the suction tube during extraction. This serves to keep the walls of the suction tube clean and also keeps the entrained dirt particles in constant motion and constantly discharges the particles along the tube towards the suction source.

Advantageously, the supply duct comprises two longitudinal walls, the first wall extending from the tube to a licker-in cover and the second wall extending from the tube to the side of the feed plate facing the licker-in. As a result, the two longitudinal walls can be smooth and continuous, so that the entire supply duct is free from corners or stagnant areas where dirt particles could be caught. This prevents any risk of accumulations of dirt dropping back.

Preferably, the suction tube is permanently secured to a machine frame above the licker-in and the first longitudinal wall of the supply duct extends downwards from the lower region of the tube and merges at least substantially tangentially into the licker-in cover. This construction of the first longitudinal wall ensures a clean tangential flow into the tube and eliminates any stagnant corners at the place of transition to the licker-in cover.

The place of transition is preferably devised so that the lowest edge of the first longitudinal wall of the supply duct extends downwards at least substantially to the lowest edge of the licker-in cover adjacent the delivery point. Since the lowest edge of the licker-in cover lies a few centimeters above the lowest edge of the feed plate, the air conveyed by the surface of the licker-in is substantially blown into the supply duct, so that the power of the suction source can be substantially reduced. This feature also ensures that any dirt particles travelling in the air stream are promptly engaged and discharged by the suction-extraction flow.

At the top end, the second longitudinal wall of the supply duct merges substantially tangentially into the tube wall and at the bottom end is preferably pressed resiliently against the side of the feed plate facing the licker-in.

Since the feed plate can be adjusted to the average staple length by being moved around the axis of rotation of the feed roller, the second longitudinal roller is pressed resiliently against the side of the feed plate facing the licker-in over the entire range of adjustment of the feed plate from the first end position thereof near the licker-in to the second end position furthest removed from the licker-in. This ensures that the suction-extraction duct is effectively sealed against the feed plate as well as the licker-in cover over the entire range of adjustment of the feed plate.

This arrangement of the two longitudinal walls also enables the walls to form a divergent supply duct when the feed plate is in the first end position, whereas in the second end position the feed duct has either a constant cross-section or a convergent shape. The advantage thereof is that over the entire range of adjustment of the feed plate, the tangential entry speed of the air into the tube can be maintained at least within acceptable limits, resulting in the aforementioned helical flow and the desired self-cleaning effect.

Finally, the front ends of the supply duct are closed by suitable side walls.

Figure 2:
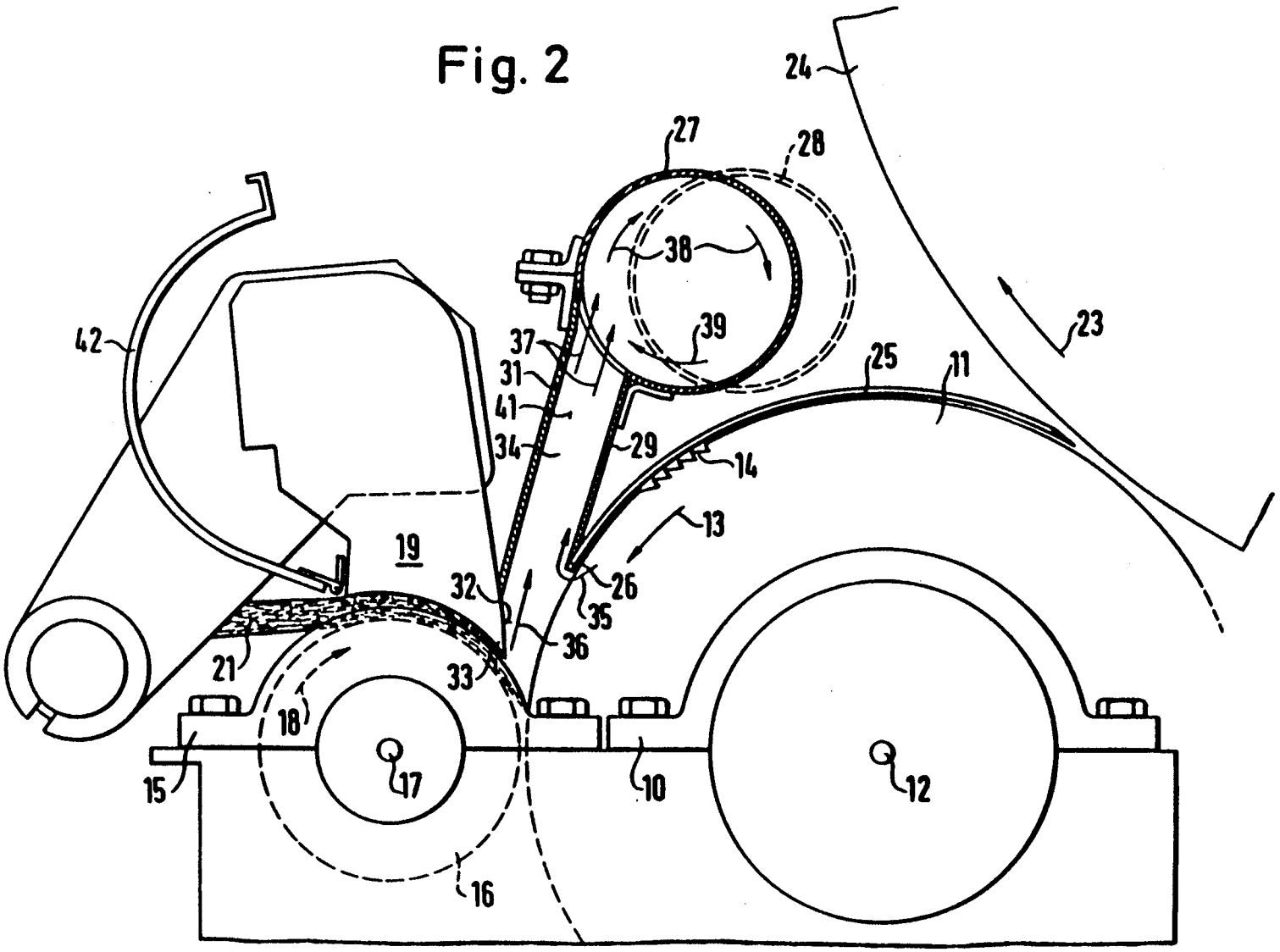

These and other objects and advantages of the invention will become more apparent taken in conjunction with the accompanying drawings wherein:

FIG. 1 illustrates a cross sectional view of a feed device constructed in accordance with the invention in a first end position; and FIG. 2 illustrates a view similar to FIG. 1 of the feed device in a second end position in accordance with the invention.

Referring to FIG. 1, the card has a bearing housing 10 for a licker-in 11 which is driven about an axis 12 in the direction indicated by the arrow 13. As indicated, the licker-in 11 has a plurality of teeth 14 on the surface as is known.

A bearing housing 15 is also disposed in front of the licker-in 11 for a feed roller 16 which is rotatably driven about an axis 17 parallel to the axis 12 of the licker-in 11. As indicated, the feed roller 16 rotates in the direction indicated by the arrow 18 so as to be co-directional with the licker-in.

A "feed plate" 19, i.e. a fiber feed plate, is disposed above the feed roller 16 and is made of a relatively rigid structure in order to define a passage for conveying a fiber lap 21 therebetween to a delivery point for delivery to the licker-in. The fiber lap 21 arrives at a feed table (not shown) so as to be conveyed by the feed roller 16 while being pressed by the feed plate 19 increasingly against the roller 16 so as to be compressed when supplied to the licker-in 11.

As illustrated in FIG. 1, the feed plate 19 is pivotally mounted to move as indicated by the arrow 50 about an axis of the feed roller 16 between a first position proximate the licker-in and a second position, as shown in FIG. 2, remote from the licker-in 11 so as to adjust to the average staple length of the fiber lap.

As indicated by the arrow 22, the feed roller 16 and licker-in 11 move in the same direction relative to the delivery point for the fiber lap 21.

As is known, during operation, the fibers combed out of the lap 21 by the licker-in 11 are conveyed and delivered to a swift 24 which has a toothed clothing and rotates in the direction indicated by the arrow 23. In conventional manner, the swift 24 has a large diameter and, consequently, is not further shown. At the top region, the licker-in has a cover 25 which extends over the teeth 14 which begins at a point between the swift 24 and the licker-in 11 and terminates at a point 26 opposite the feed plate 19.

A suction-extraction tube 27 of circular cross-section is disposed above the licker-in 11 and extends over the entire axial length of the licker-in 11 in parallel to the axis of rotation 12. This tube 27 is curved slightly at one end, i.e. the end behind the plane of the drawing, to lead to a suction source (not shown). This curved end is diagrammatically indicated by a circle 28 representing the cross-section of the tube after the curve.

A supply duct 34 extends transversely from the delivery point for the fiber lap 21 upwardly to the suction tube 27 and opens tangentially into the tube 27 along an axial length thereof for delivering dirt particles extracted from the fiber lap at the delivery point to the tube 27.

A first longitudinal wall 29 of a supply duct 34 is secured by a suitable bracket to the tube 27 and extends downwards from the underside of the tube 27 to a short distance into front of the lowest part 26 of the licker-in cover 25, where the longitudinal wall 29 merges substantially tangentially into the licker-in cover 25. To the left thereof, a second longitudinal wall 31 of the supply duct 34 made of sheet spring steel presses against a side 32 of the feed plate 19 facing the licker-in 11, relatively near the lowest edge 33 thereof. As can be seen, the top region of the second longitudinal wall 31 merges substantially tangentially into the wall of tube 27. The two walls 29, 31 thus define a suction nozzle at one end of the supply duct 34 at the delivery point for the fiber lap 21 and a diverging space which extends from the suction nozzle to the suction tube 27.

In the end position of the feed plate shown in FIG. 1, the supply duct 34 formed by the two longitudinal walls 29, 31 has a divergent shape in the direction of tube 27, due to the fact that the feed plate 19 can pivot around the feed-roller axis as shown by arrow 50. During operation, a suction source (not shown) is connected to the tube 27 (at 28) and sucks air through it. Furthermore, the licker-in 11, owing to the teeth 14, entrains a considerable amount of air and, after passing the lowest edge 26 of the licker-in cover 25, the air flows into the supply duct 34. The fiber lap 21 compressed between the feed roller 16 and the feed plate 19 is permeable to air to some extent, in spite of being compressed, and air also flows out of the fiber lap at the delivery point as indicated by arrow 36.

The air flow indicated by arrow 35 and the air flow indicated by arrow 36 both contain dirt particles and continue to flow along the supply duct 34 until they finally flow tangentially into tube 27 as indicated by arrows 37. In the tube 27 itself, as a result of the suction and the inflowing air 37 and dirt particles, a helical flow occurs (shown by arrows 38) and extends over the entire inner wall of tube 27 and prevents dust particles from accumulating therein. Since the opening of the supply duct 34 into the tube extends over the entire axial length of the licker-in 11, particles in the air flow which travel across the opening of the supply duct 34 into the tube 27 theoretically have a chance of flowing back into the supply duct 34. However, this is prevented by the ascending tangentially-introduced flow 37. In this manner, the dirt particles sucked from the transition place or removed from the licker-in teeth or the air entrained therewith can be removed so that no dirt particles can drop back to the delivery place.

FIG. 2 shows the arrangement after the feed plate 19 has pivoted around the axis of rotation 17 of the feed roller 16 into the second end position. Of course, the feed plate 19 can be secured not only in the two end positions but in any desired position between them. The feed plate 19 itself is constructed as described in European Patent Applications 87 118 415.6 and 87 118 414.9. An important feature of the present description is that the second longitudinal wall 31, which is resiliently pressed against the feed plate 19, continues in the second end position (and in all intermediate positions) to press against the side 32 of the fed plate 19 facing the licker-in 11. To this end, the wall 31 has a tapered lower end to remain flat against the plate 19. In the second end position, the supply duct 34 preferably has a substantially constant cross-section, although the cross-section can also be slightly convergent. This has the special advantage that in spite of the adjustment of the feed plate 19, the air flow speed at the place where the air enters the tube 27 can be kept within acceptable limits, so as always to produce the desired helical flow.

The supply duct 34 projects laterally, as viewed, beyond the fed plate 19 so that the ends of duct 34 are covered by plates 41, i.e. so that the two plates 41 are permanently connected to the longitudinal wall 29 but project beyond the longitudinal wall 31, so that the cover plates 41 provide a cover even when the supply duct 34 is at a maximum width as show in FIG. 2.

A guide plate 42 is also provided to help in inserting the fiber lap between the fed plate 19 and the feed roller 16. After the insertion process, the plate 42 can be folded downwards onto the surface of the fiber lap.

The invention thus provides a relatively simple device for extracting impurities from a fiber lap delivered to a licker-in of a card.

In addition, the invention provides a device which can be operated in a relatively inexpensive manner so as to remove impurities from a fiber lap delivered to a licker-in as well as from the licker-in before the impurities can be pressed into the lap by the licker-in.

What is claimed is:

1. A feed device for a card comprising a feed roller;

a feed plate disposed in spaced relation to said roller to define a passage for conveying a fiber lap therebetween to a delivery point for delivery to a licker-in;

a suction tube extending longitudinally of said roller and said plate and being connectable at one end to a suction source; and a supply duct extending transversely from said delivery point upwardly to said suction tube and opening tangentially into said tube along an axial length thereof for delivering dirt particles extracted from the fiber lap at said delivery point to said suction tube, said supply duct having a suction nozzle at one end at said delivery point and a diverging space extending from said suction nozzle to said suction tube.

2. A feed device for a card comprising a feed roller;

a feed plate disposed in spaced relation to said roller to define a passage for conveying a fiber lap therebetween to a delivery point for delivery to a licker-in;

a suction tube extending longitudinally of said roller and said plate and being connectable at one end to a suction source; and a supply duct extending transversely from said delivery point to said suction tube and opening tangentially into said tube along an axial length thereof for delivering dirt particles extracted from the fiber lap at said delivery point to said suction tube, said supply duct having a first wall merging at an upper end substantially tangentially into said tube and being resiliently biased at a lower end against said feed plate.

3. A feed device as set forth in claim 2 wherein said feed plate is pivotally mounted to move about an axis of said feed roller between a first position proximate a licker-in and a second position remote from the licker-in to adjust to the average staple length of the fiber lap, said wall of said supply duct being biased against said feed plate in each said end position.

4. A feed device as set forth in claim 3 wherein said supply duct has a second wall opposite said first wall to define a divergent space therebetween in said first position of said first wall.

5. A feed device as set forth in claim 4 wherein said walls define a space of at least constant cross-section therebetween in said second position of said first wall.

6. A feed device as set forth in claim 3 wherein said supply duct has a pair of side walls secured to said second wall and extending beyond said first wall in said first position of said first wall.

7. In combination a licker-in for a card;

a feed roller parallel to said licker-in for conveying a fiber lap therebetween;

a feed plate disposed in spaced relation to said feed roller to convey a fiber lap therebetween to a delivery point for delivery to between said feed roller and said licker-in;

a suction tube extending longitudinally of said roller and said plate and being connectable at one end to a suction source; and a supply duct extending transversely from said delivery point upwardly to said suction tube and opening tangentially into said tube along an axial length thereof for delivering dirt particles extracted from the fiber lap at said delivery point to said suction tube; said supply duct having a suction nozzle at one end at said delivery point and a diverging space extending from said suction nozzle to said suction tube.

8. The combination as set forth in claim 7 which further comprises a cover disposed in spaced relation over said licker-in and wherein said supply duct includes a first wall extending from said tube to said cover and an opposed second wall extending from said tube to said feed plate.

9. The combination as set forth in claim 8 wherein said tube is disposed above said licker-in and said first wall merges tangentially into said cover.

10. The combination as set forth in claim 8 wherein said first wall merges into said cover adjacent said delivery point.

11. In combination a licker-in for a card;

a cover disposed in spaced relation over said licker-in;

a feed roller parallel to said licker-in for conveying a fiber lap therebetween;

a feed plate disposed in spaced relation to said feed roller to convey a fiber lap therebetween to a delivery point for delivery to between said feed roller and said licker-in;

a suction tube extending longitudinally of said roller and said plate above said licker-in and being connectable at one end to a suction source; and a supply duct extending transversely from said delivery point to said suction tube and opening tangentially into said tube along an axial length thereof for delivering dirt particles extracted from the fiber lap at said delivery point to said suction tube, said supply duct including a first wall extending from said tube to merge tangentially into said cover adjacent said delivery point and an opposed second wall extending tangentially from said tube to said feed plate and being resiliently biased at a lower end against said fed plate.

12. The combination as set forth in claim 11 wherein said feed plate is pivotally mounted to move about an axis of said feed roller between a first position proximate a licker-in and a second position remote from the licker-in to adjust to the average staple length of the fiber lap, said wall of said supply duct being biased against said feed plate in each said end position.

13. The combination as set forth in claim 12 wherein said walls define a divergent space in said first position.

14. The combination as set forth in claim 13 wherein said walls define a space of constant cross-section in said second position.

15. The combination as set forth in claim 12 wherein said supply duct has a pair of side walls secured to said second wall and extending beyond said first wall in said first position.

* * * * *

UNITED STATES PATENT AND TRADEMARK OFFICE

CERTIFICATE OF CORRECTION

PATENT NO. : 5,038,439

DATED : August 13, 1991

INVENTOR(S) : GIUSEPPE VERZILLI

It is certified that error appears in the above-identified patent and that said Letters Patent is hereby corrected as shown below:

Column 4, line 50 change "fed" to -feed-
Column 4, line 61 change "fed" to -feed-
Column 4, line 68 change "fed" to -feed-
Column 6, line 51 change "fed" to -feed-
Column 4, line 66 change "show" to -shown- Signed and Sealed this Thirteenth Day of July, 1993

*Attest:*

Michael K. Kirk

MICHAEL K. KIRK

*Attesting Officer*

*Acting Commissioner of Patents and Trademarks*